US006076758A

United States Patent [19]

Kieves et al.

[11] Patent Number: 6,076,758

[45] Date of Patent: Jun. 20, 2000

[54] BALLOON WEIGHT

[75] Inventors: Garry Kieves, Minnetonka; Mark Steven Sifferlin, Edina; Paul Joseph Sable, Crystal; Paul Andrew Ansolabehere, Minnetonka, all of Minn.

[73] Assignee: Anagram International, Inc., Minneapolis, Minn.

[21] Appl. No.: 09/181,309

[22] Filed: Oct. 28, 1998

[51] Int. Cl.[7] ..... B65H 75/40

[52] U.S. Cl. ..... 242/400.1; 242/404.3; 242/407; 242/402; 242/605; 446/220

[58] Field of Search ..... 242/400.1, 404.3, 242/405.1, 405.2, 407, 580, 605, 402; 446/220, 221, 222, 223, 224, 225, 226; 244/31

[56] References Cited

U.S. PATENT DOCUMENTS

| | | | |
|---|---|---|---|
| D. 33,084 | 8/1900 | Hazen . | |
| D. 240,612 | 7/1976 | Becker . | |
| D. 354,899 | 1/1995 | Messier . | |
| D. 401,255 | 11/1998 | Burns . | |
| 1,256,278 | 2/1918 | Takeuchi | 242/405.1 |
| 1,554,082 | 9/1925 | Gerould | 242/404.3 |
| 1,910,597 | 5/1933 | Elliott | 242/405.1 |
| 2,834,507 | 5/1958 | Metzler et al. | 242/605 |
| 3,062,475 | 11/1962 | Miller | 242/404.3 |
| 4,702,035 | 10/1987 | Palm | 242/405.1 |
| 4,862,635 | 9/1989 | Conte | 242/402 |
| 5,011,447 | 4/1991 | Watanabe | 242/405 |
| 5,035,391 | 7/1991 | Steele et al. . | |
| 5,074,510 | 12/1991 | Metz . | |
| 5,086,988 | 2/1992 | LaPoint et al. | 242/405 |
| 5,188,314 | 2/1993 | Peters | 242/129 |
| 5,240,199 | 8/1993 | Peters | 242/405.1 |
| 5,411,427 | 5/1995 | Nelson et al. . | |
| 5,662,510 | 9/1997 | Wolens . | |

*Primary Examiner*—John M. Jillions
*Attorney, Agent, or Firm*—McDonnell Boehnen Hulbert & Berghoff

[57] ABSTRACT

A weight for a lighter-than-air balloon is disclosed. The weight includes a spool, adapted to receive a ribbon for attachment to the balloon, and a hook, including a ribbon catch and adapted to facilitate display of the balloon.

7 Claims, 3 Drawing Sheets

58
60
32
30
10

BALLOON WEIGHT

BACKGROUND OF THE INVENTION

The present invention relates generally to a weight for a lighter-than-air balloon and particularly to a weight for a non-latex, helium-filled balloon.

Non-latex balloons, sometimes referred to as mylar or metallic-coated balloons, have grown in popularity since the 1980's. This type of balloon is described in U.S. Pat. Nos. 4,077,588 and 4,927,644, and the teachings thereof are incorporated herein by reference.

To avoid loss of such balloons through inadvertent release, various weights have been developed. Typically the weight includes a ribbon for attachment to the stem of the non-latex balloon by, for example, tying or tape. Two such weights are described in U.S. Pat. Nos. 5,188,314 and 5,240,199, and the teachings thereof are incorporated herein by reference.

SUMMARY OF THE INVENTION

In a principal aspect, the present invention is a weight including a spool and a hook. A ribbon is wound about the spool and adapted for attachment to the stem of a lighter-than-air balloon.

The hook extends outwardly from one of the spool flanges. The hook defines a catch adapted to receive and retain the ribbon, such that the length of ribbon between the balloon and weight can be set. The hook allows the balloon to be displayed in an inflated, lighter-than-air state.

It is thus an object of the present invention to provide an inexpensive, readily manufactured balloon weight. Another object is a lighter-than-air balloon weight that facilitates display of the balloon.

Yet another object of the present invention to provide an interlocking balloon weight for use with a balloon cluster or grouping. It is also an object to provide a balloon weight having a pocket adapted to receive a weight in order to accommodate large helium-inflated balloons.

These and other features, objects and advantages of the present invention are described or implicit in the following detailed description.

DESCRIPTION OF THE DRAWING

Preferred embodiments of the present invention are described herein with reference to the drawing wherein.

DETAILED DESCRIPTION OF PREFERRED EMBODIMENTS

Figure 1:
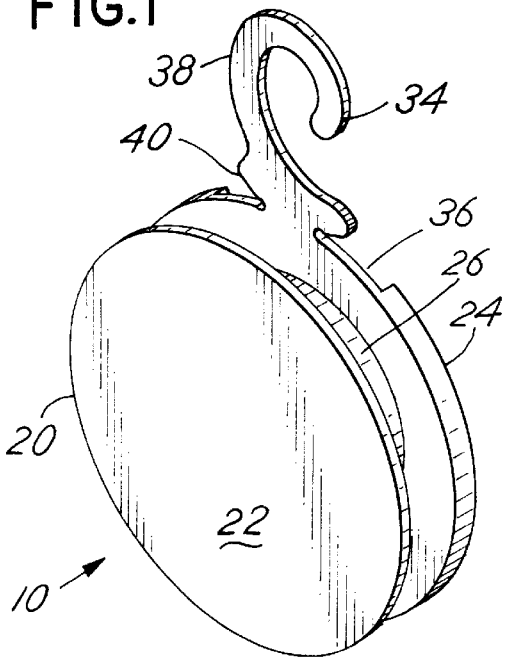
FIG. 1 is a front perspective view of a preferred embodiment of the present invention.
Figure 5:
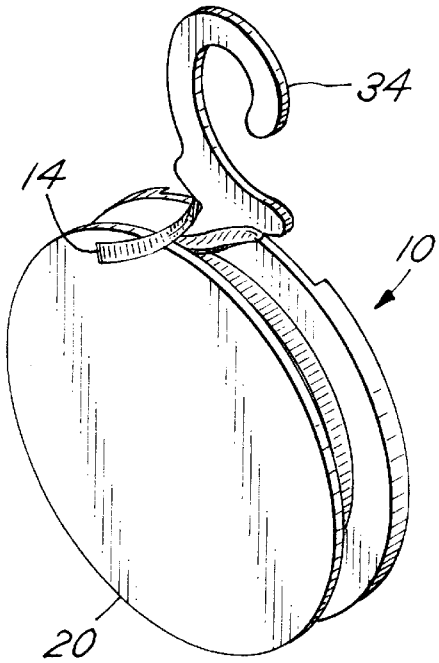
FIG. 5 is a back perspective view of the balloon weight shown in FIG. 1.
Figure 2:
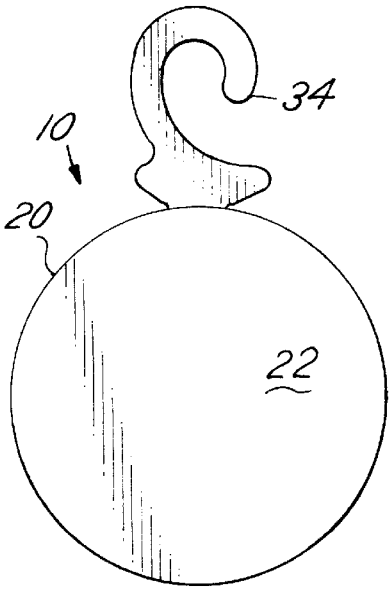
FIG. 2 is a front view of the balloon weight shown in FIG. 1.
Figure 6:
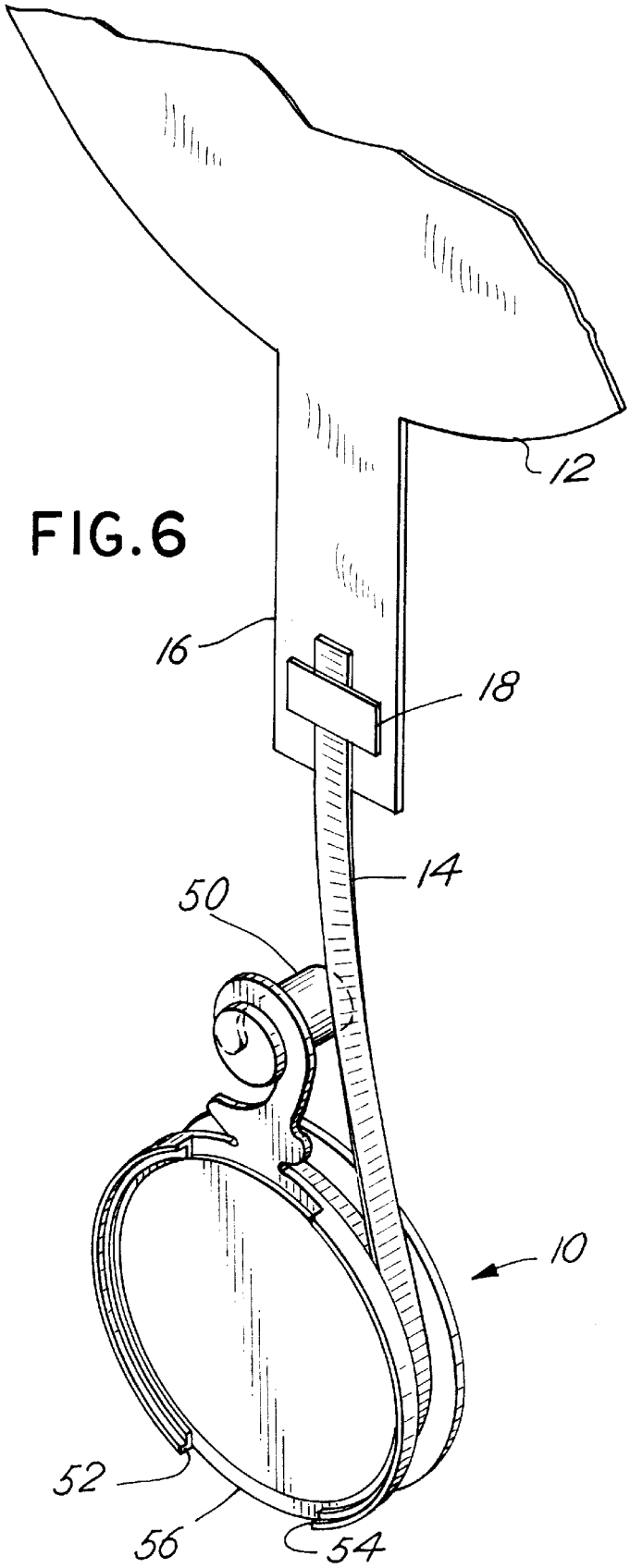
FIG. 6 is a perspective view illustrating the balloon weight attached to a lighter-than-air balloon and mounted on a peg.

With particular reference to FIGS. 1, 5 and 6, a preferred embodiment of the present invention is shown as a weight, generally designated 10, for a non-latex, helium-filled balloon 12. The weight 10 includes a length of ribbon 14, which is attached or secured to a stem 16 of the balloon 12 by a piece of tape 18.

Figure 3:
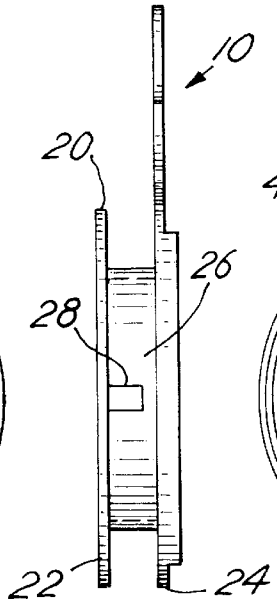
FIG. 3 is a side view of the balloon weight shown in FIG. 1.
Figure 7:
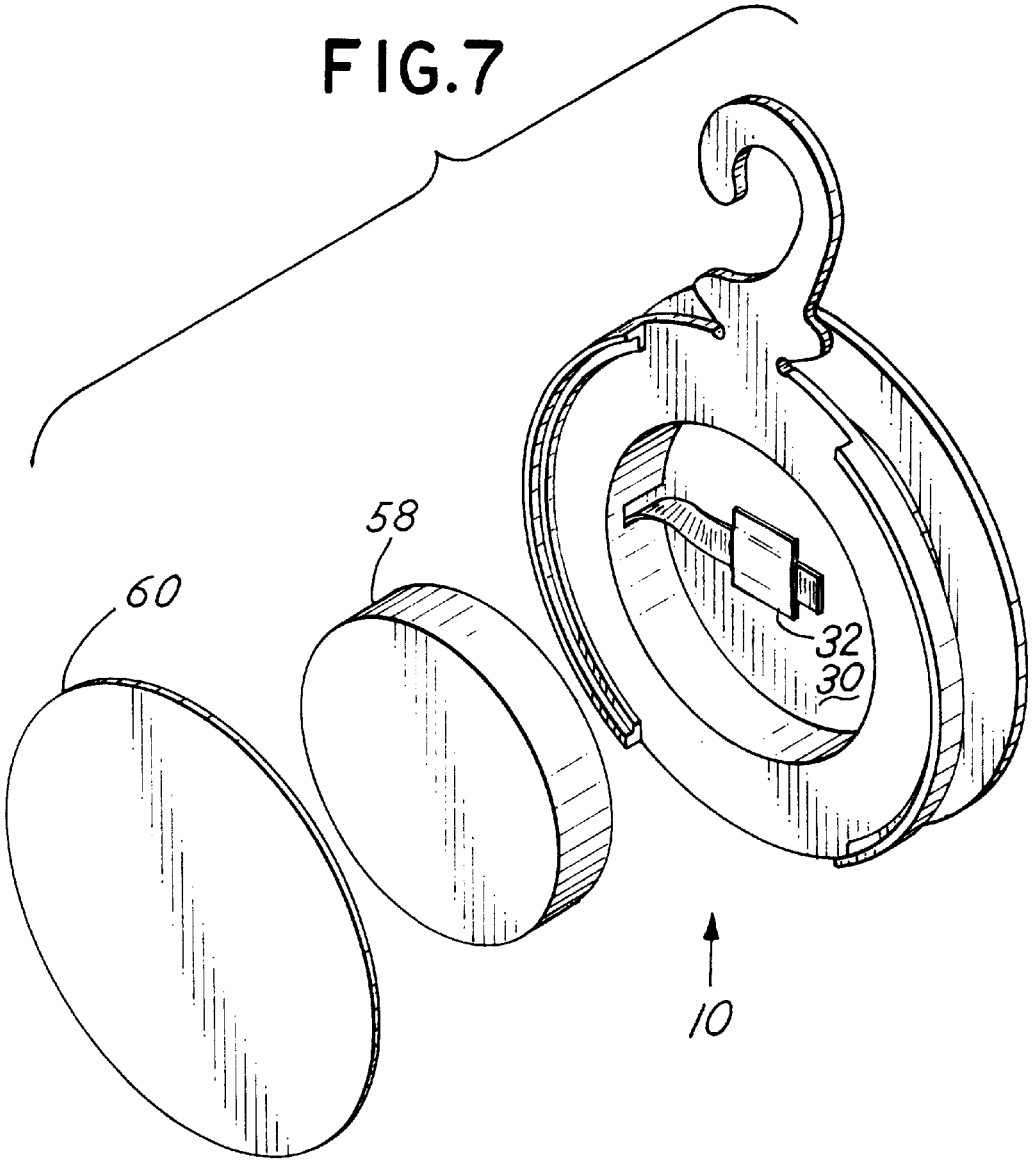
FIG. 7 is an exploded perspective view of another preferred embodiment of the present invention.

More particularly, the weight 10 includes a spool 20, having a first or front flange 22 and a second or back flange 24, connected by a hollow hub 26. In this preferred embodiment, the flanges 22, 24 are substantially circular; the hub 26 is substantially cylindrical and centrally located, such that the flanges 22, 24 and hub 26 are substantially coaxial. The ribbon 14 is wounded about the hub 26 and passes through a slot 28, into a substantially cylindrical, central pocket 30, for attachment to the first flange 22 by a piece of tape 30, as best shown in FIGS. 3 and 7.

A hook 34 extends outwardly from the outer periphery 36 of the second flange 24. Referring to FIG. 1, the hook 34 includes a substantially J-shaped hook section 38 and a neck section 40, which joins the second flange 24 and the J-shaped hook section 38.

The neck section 40 has first and second opposed, substantially triangular notches 42, 44, respectively, therein, substantially adjacent the outer periphery 36 of the second flange 24. As such, the hook 34 defines and includes first and second catches, generally designated 46, 48, respectively, adapted to receive and retain the ribbon 14, whereby a predetermined length of tether, between the weight 10 and balloon 12, is fixedly established. The ribbon 14 may be secured within one of the catches 46 or 48, or wrapped about the neck section 40 and within both catches 46, 48.

The weight 10 facilitates display of the inflated lighter-than-air balloon 12. The J-shaped hook section 38 allows the weight to hang from a permanent structure, such as a peg 50, with the balloon 12 arising above by the tethered length of ribbon 14.

Figure 4:
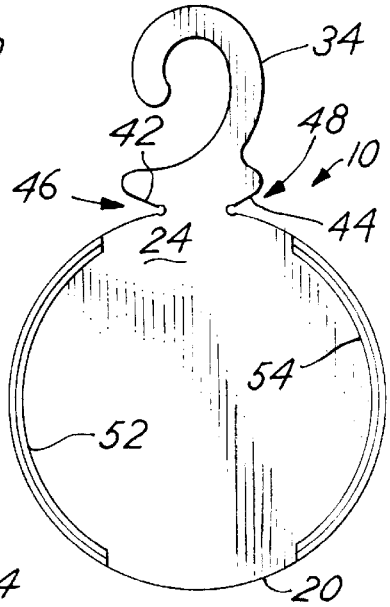
FIG. 4 is a back view of thereof.

The weight 10 is sufficient to counterbalance the lift of a conventional 18" balloon. To accommodate a balloon cluster (not shown), the weight 10 includes a pair of opposed substantially L-shaped lips 52, 54, respectively, extending partially along the outer periphery 56 of the second flange 22. The lips 52, 54 receive and hold the first flange 22 of another balloon weight 10, releasably securing one weight 10 to the another. As best shown in FIG. 4, the lips 52, 54 extend approximately one-quarter of the outer periphery 56, substantially equally offset from the hook 34.

In this preferred embodiment, the weight 10 includes two halves or pieces, molded using any conventional technique, e.g., injection molding. The substantially circular first flange 22 defines the first half of the weight 10. The second half includes the substantially circular second flange 24, hollow hub 26, hook 34 and lips 52, 54. The first flange 22 is secured the hub 26 by an adhesive (not shown).

In the preferred embodiment shown in FIG. 7, the second flange 24 is substantially annular, such that the pocket 30 defined by the hub 26 is accessible in the assembled state of the weight 10. A metal disc 58, representing a secondary weight, is inserted into the pocket 30 for additional counterbalance, such that the weight 10 may be used with a larger-than-conventional balloon 12. The pocket 30 is then sealed or closed by a substantially circular foil 60, secured by an adhesive to the second flange 24.

Various preferred embodiments have been described herein. It should be understood, however, that changes and modifications can be made without departing from the true scope and spirit of the present invention, as set forth in the following claims.

What is claimed is:

1. A weight comprising, in combination:

a spool having a first flange, a second flange and a central hub joining said first and second flanges, said spool receiving a ribbon wound about said central hub; and a hook extending substantially outwardly from said second flange and defining a first catch to receive and retain said ribbon, whereby a predetermined length of ribbon between said spool and said lighter-than-air balloon is fixedly established;

said hook being substantially coplanar with said second flange and including a substantially J-shaped hook section and an interconnecting neck section, said neck section defining said first catch, said weight being hangable by said substantially J-shaped hook section.

2. A weight as claimed in claim 1 wherein said central hub is hollow and defines a pocket therein, said central hub further defining a slot, said ribbon passing through said slot for attachment to said weight within said pocket.

3. A weight as claimed in claim 1 wherein said central hub is hollow and defines a pocket therein, said weight further comprising a secondary weight held within said pocket.

4. A weight as claimed in claim 1 or 2 or 3 further comprising a pair of opposed lips extending from said second flange, said lips interconnecting said weight to another weight by releasably receiving a first flange of said another weight.

5. A weight for a lighter-than-air balloon comprising, in combination:

a spool having a first flange, a second flange and a central hub joining said first and second flanges, said spool receiving a ribbon wound about said central hub for attachment to said lighter-than-air balloon, said second flange including a pair of opposed lips extending therefrom, said lips interconnecting said weight to another weight by releasably receiving a first flange of said another weight; and a hook extending substantially outwardly from said second flange and defining a first catch to receive and retain said ribbon, whereby a predetermined length of ribbon between said spool and said lighter-than-air balloon is fixedly established.

6. A weight as claimed in claim 5 wherein said central hub is hollow and defines a pocket therein, said central hub further defining a slot, said ribbon passing through said slot for attachment to said weight within said pocket.

7. A weight as claimed in claim 5 wherein said central hub is hollow and defines a pocket therein, said weight further comprising a secondary weight held within said pocket.

* * * * *

UNITED STATES PATENT AND TRADEMARK OFFICE

CERTIFICATE OF CORRECTION

PATENT NO. : 6,076,758 
DATED : June 20, 2000
INVENTOR(S) : Kieves, G., Sifferlin, M.S., Sable, P.J. and Ansolabehere, P.A.

It is certified that error appears in the above-identified patent and that said Letters Patent is hereby corrected as shown below:

Column 3,
Line 9, delete "said lighter" and replace with -- a lighter --.

Signed and Sealed this

Second Day of July, 2002

*Attest:*

*Attesting Officer*

JAMES E. ROGAN
*Director of the United States Patent and Trademark Office*